United States Patent [19]

Loretti et al.

[11] Patent Number: 4,997,083

[45] Date of Patent: Mar. 5, 1991

[54] CONTAINER INTENDED FOR THE SEPARATE STORAGE OF ACTIVE COMPOSITIONS AND FOR THEIR SUBSEQUENT MIXING

[75] Inventors: Maurice Loretti, Chatelaine; Pierre Vanat, Geneva, both of Switzerland; Jacques Andre, Annemasse, France

[73] Assignee: Vifor S.A., Switzerland

[21] Appl. No.: 455,793

[22] Filed: Dec. 27, 1989

Related U.S. Application Data

[63] Continuation of Ser. No. 199,545, May 27, 1988, abandoned.

[30] Foreign Application Priority Data

May 29, 1987 [CH] Switzerland ..... 2066/87

[51] Int. Cl.[5] ..... B65D 30/22; B65D 81/18; B65D 81/37

[52] U.S. Cl. ..... 206/219; 53/425; 53/433; 53/434; 383/38; 604/410

[58] Field of Search ..... 206/219, 222; 604/410, 604/416; 53/425, 433, 434

[56] References Cited

U.S. PATENT DOCUMENTS

| | | | |
|---|---|---|---|
| 3,545,671 | 12/1970 | Ross | 604/410 |
| 3,964,604 | 6/1976 | Prenntzell . | |
| 4,396,383 | 2/1983 | Hart . | |
| 4,458,733 | 7/1984 | Lyons | 206/219 |
| 4,467,588 | 8/1984 | Carveth | 206/219 |
| 4,484,920 | 11/1984 | Kaufman et al. . | |
| 4,507,114 | 3/1985 | Bohman | 206/219 |
| 4,528,220 | 7/1985 | Hwo | 383/109 |
| 4,559,053 | 12/1985 | Porges | 604/408 |
| 4,608,043 | 8/1986 | Larkin | 604/410 |

FOREIGN PATENT DOCUMENTS

| | | |
|---|---|---|
| 364073 | 10/1962 | Switzerland . |
| 660868 | 5/1987 | Switzerland . |

*Primary Examiner*—Stephen P. Garb
*Attorney, Agent, or Firm*—Pennie & Edmonds

[57] ABSTRACT

The container (1) is intended for the separate storage of active compositions, especially of liquids or solutions, and for their subsequent mixing just before use.

It comprises at least three compartments (3, 4, 5) separated from one another by leakproof seams (6) of the material of the envelope (2), sealable inlet passages (7, 8), sealed transfer passages (10, 11) and a sealable outlet passage (9). The envelope is made of a polymerized and homogeneous flexible material which is chemically inert to each of said compositions and to their mixtures.

7 Claims, 1 Drawing Sheet

FIG. 1
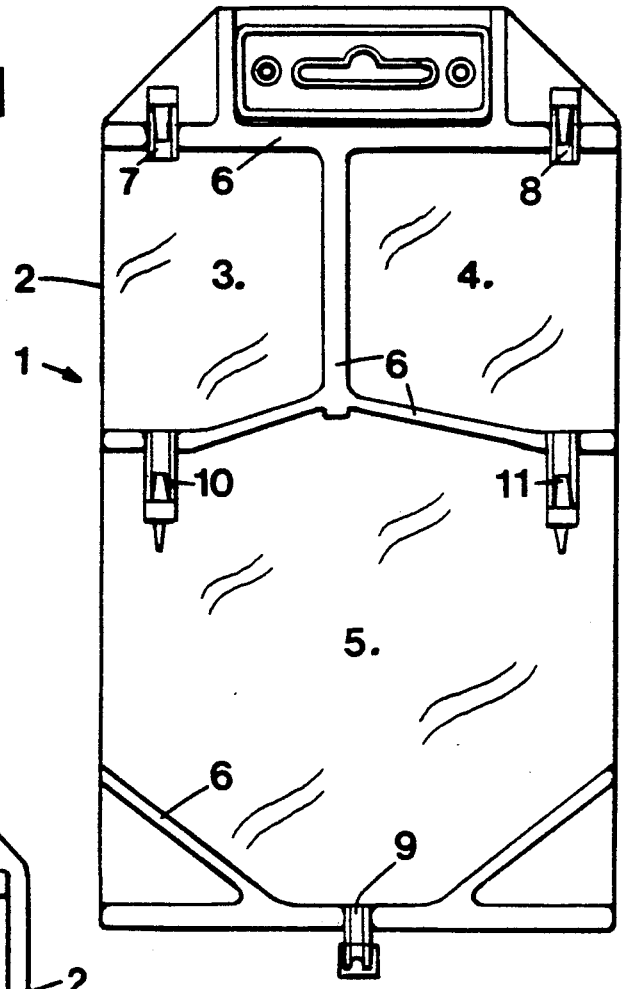
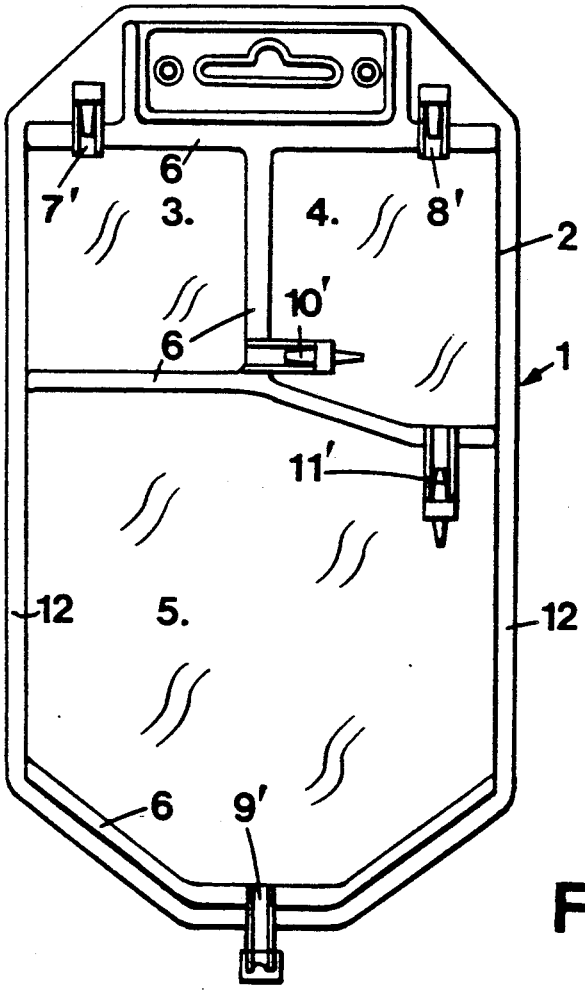
FIG. 2

CONTAINER INTENDED FOR THE SEPARATE STORAGE OF ACTIVE COMPOSITIONS AND FOR THEIR SUBSEQUENT MIXING

This is a continuation of application Ser. No. 07/199,545, filed May 27, 1988.

The invention relates to a container intended for the separate storage of active compositions, especially in the form of liquids or solutions, and for their subsequent mixing just before use. This invention finds an application in extremely varied fields such as medicine, chemistry or cosmetics for example.

In the pharmaceutical field, and more precisely in the area of solutions for perfusions, flexible bags have already been used for some time for administering mixtures of amino acids and glucose. Since such mixtures cannot be subjected as such to sterilization (possibility of Maillard reactions), it is expedient to sterilize and to separately store the amino acids and the glucose solution. In order to provide for the mixture of these and then the administration of this mixture under absolutely sterile conditions, it is advantageous to use a container such as a flexible bag with two compartments.

A known model of a container with two compartments can be succinctly described as follows: The upper compartment, intended to contain an aqueous solution of amino acids, is provided, at its top, with a sealable passage used for introducing said solution and, at its base, with a sealed transfer passage emptying into the lower compartment intended to contain the glucose solution. After rupture of the seal, the sterile mixture of amino acids is transferred into the lower compartment, the final product then being able to flow off through an outlet passage situated at the base of the lower compartment. Such containers are based on polymerized flexible material, for example polyethylene.

However, such containers are not suitable for the storage and sterile administration of more complex mixtures, such as ternary mixtures of active compositions. Moreover, although polymer materials are at present available which have all the desired qualities, especially chemical inertness to amino acids, glucose and their mixture, the expert is completely without resource when it is a question of solving this problem for more complex mixtures. This is the case, inter alia, when it is attempted to sterilize and separately store amino acids, lipids and sugars such as glucose, and then to administer the resulting mixture of these in the form of a solution for perfusion.

The invention makes it possible to advantageously overcome this shortcoming and to provide a solution which is not limited only to the pharmaceutical field, but can be applied advantageously to all types of fields. It consists of a container such as defined in claim 1.

The attached drawings illustrate, by way of example, some of the embodiments of the invention. Other embodiments will be described in the course of the description.

FIG. 1 shows, in a plan view, a particular embodiment of the invention.

FIG. 2 shows, in a plan view, another embodiment of the invention.

According to the invention, the container 1, intended for the separate storage of active compositions, especially of liquids or solutions, and for their subsequent mixing just before use, comprises a flexible and leakproof envelope divided into several compartments, each provided with a sealable passage making it possible to introduce into it, from the outside, a composition or a mixture of compositions, and to empty it of its contents towards the outside, and each provided with a sealed passage which can be opened at will in order to make it possible to transfer the contents of one given compartment into another.

This container 1 is defined by the fact that it comprises at least three compartments 3, 4, 5 separated from one another by leakproof seams 6 of the material of the envelope 2, and the envelope 2 is made of a polymerized and homogeneous flexible material which is chemically inert to each of the compositions in question and to their mixtures.

In a preferential embodiment the container 1 comprises, in its upper part, two adjacent compartments 3, 4 each provided, at their top, with a sealable inlet passage 7, 8 and, at their base, with a sealed transfer passage 10, 11 emptying into the lower compartment 5, the latter being provided, at its base, with a sealable outlet passage 9.

Such an embodiment is illustrated by FIG. 1.

In another embodiment of the invention the container 1 comprises, in its upper part, two adjacent compartments 3, 4 each provided, at their top, with a sealable inlet passage 7', 8', the compartment 3 comprising, at its base, a sealed transfer passage 10' emptying into the adjacent compartment 4, the latter being provided, at its base, with a sealed transfer passage 11' emptying into the lower compartment 5, itself provided with a sealable outlet passage 9'. Such an embodiment is illustrated by FIG. 2.

The inlet passages 7, 8 or 7', 8' are mostly rigid or semi-rigid and welded integral with the envelope. They are most often sealed, after the introduction of the given compositions into their respective compartments, by any adequate means ensuring an absolutely leakproof seal, preferably resistant to the sterilization conditions. The same applies to the outlet passage 9, or 9', it being possible for the latter to be additionally connected to a joining piece, or perforated by a hollow needle, for removal of the mixture ready for use.

The transfer passages 10, 11 or 10', 11' can comprise rigid or semi-rigid parts, depending on the circumstances. They can consist of a joining piece which can be broken by hand, of a seam which can be torn under the effect of a lateral pressure, or of a ball which is held tight in a flexible tube and which can be pushed out by hand. Such passages make use of known techniques and can ensure, if necessary, the sterile transfer of the contents of one compartment into another. As a rule, they are welded integral with the envelope.

In order to achieve the set aims, the material of the envelope must meet several conditions. The essential point is that it must be flexible, of homogeneous composition and chemically and biologically inert to each of the compositions in question and to their mixtures. Moreover, it must be weldable by means of the conventional techniques such as heat welding, ultrasonic welding or high-frequency welding, and must be compatible with the materials currently used to produce the passages mentioned above. It must also be leakproof to liquids, gases and vapors, and preferably transparent, although this latter condition is not absolutely necessary.

The envelope 2 can be made up of a single sheet of a polymerized material satisfying the conditions listed hereinabove. The envelope 2 can also be made up of a composite sheet, double or even triple depending on the circumstances, with only the material in contact with the given compositions then having to be chemically inert to the latter or to their mixtures.

Among the polymerized materials satisfying advantageously the conditions listed hereinabove, there may be mentioned the following materials: polyethylene of high density, polypropylene, blocked polyether/polyamide or mixtures of polyethylene and styrene/ethylene/butyl, polyethylene and ethylene vinyl acetate, linear polyethylene, polypropylene and styrene/ethylene/butyl. Such materials are used to preferably make a single sheet or, depending on the circumstances, the inner layer of a composite sheet. As complex materials constituting composite sheets, the following may be mentioned: polyamide/polypropylene (PA/PP), low-density or high-density linear polyamide/polyethylene (PA/PE) for example.

Such materials have proven particularly well suited to the manufacture of containers according to the invention, in particular flexible and leakproof bags intended for the separate storage and then for the subsequent mixing, under sterile conditions, of lipids, amino acids and solutions of sugars such as glucose.

In one of its preferred embodiments, the container of the invention can be used as follows. Into the compartment 3 of the container according to FIG. 1 there is introduced an emulsion based on lipids (essentially the triglycerides) which can be assimilated by the human body. Into the compartment 4 there is introduced an aqueous solution of essential amino acids and, into the lower container 5, an aqueous solution of glucose, for example at 40% in $H_2O$. These liquids are introduced, using the conventional techniques, through the passages 7, 8 and 9 respectively, which are then sealed in a leakproof manner after the introduction. The container thus filled can then be sterilized in an autoclave (temp. $>100°$ C.) and stored in this state for several months, or even several years.

Before use in the form of a perfusion, the following procedure is carried out: The breakable passage 11 is burst by hand and the solution of amino acids is passed into the lower compartment 5. The mixture can be activated by trituration of the compartment 5. An identical procedure is carried out with the breakable passage 10, with the emulsion of lipids passing into the compartment 5. After a fresh mixing of the components together, the resultant mixture, ready for use, can be administered once the joining piece 9 has been connected to a perfusion tube for example.

This description is not in any way limiting, and such a container can also be used in cosmetics (treatment emulsions, shampoo rinses), in the field of adhesives having several components, of synthetic resins, or for the preparation of reactive mixtures of all types.

We claim:

1. A container comprising a flexible envelope formed of a polymerized material, comprising three compartments for the separate storage of compounds of lipids, amino acids and sugars and their subsequent mixtures just before use, wherein the said container further comprises, in its upper part, two adjacent upper compartments situated at the same level, a third lower compartment located below and adjacent the two compartments, each compartment being provided with a sealable passage allowing for introduction into it from outside of a particular compound and to empty the contents from the third compartment, sealed and openable passage means connecting the two compartments to the third compartment for transferring the contents of the two compartments to the third compartment, said passage means comprising no more than a single passage between any of the compartments, the material forming the envelope being chemically and biologically inert with respect to each of the compounds and to their mixtures.

2. The container as claimed in claim 1, wherein the sealed transfer passages are breakable by hand.

3. The container as claimed in claim 1, wherein the material of the envelope in contact with compounds is polypropylene.

4. The container as claimed in claim 1, wherein the envelope is made up of a single sheet.

5. The container as claimed in claim 1, wherein the envelope is made up of a composite sheet.

6. The container as claimed in claim 1, wherein each of the two upper compartments are separately connected to only said third lower compartment solely by a separate single passage between each of the upper compartments and the third compartment.

7. The container as claimed in claim 1 wherein said two adjacent upper compartments are connected together solely by a single passage and only one of the two adjacent upper compartments is connected to the third lower compartment solely by a single passage.

* * * * *